US005147073A

United States Patent [19]

Cater

[11] Patent Number: 5,147,073

[45] Date of Patent: Sep. 15, 1992

[54] FLUID PUMP DISPENSER FOR PHARMACEUTICAL USE

[75] Inventor: Miro S. Cater, Newtown, Conn.

[73] Assignee: Spruhventile GmbH, Fed. Rep. of Germany

[21] Appl. No.: 653,048

[22] Filed: Feb. 11, 1991

[51] Int. Cl.[5] ..... B65D 88/54

[52] U.S. Cl. ..... 222/321; 222/341; 222/385; 222/400.5; 222/402.2

[58] Field of Search ..... 222/372, 376, 377, 378, 222/379, 380, 381, 382, 383, 385; 417/510

[56] References Cited

U.S. PATENT DOCUMENTS

| | | | |
|---|---|---|---|
| 4,089,442 | 5/1978 | Hafele et al. | 222/385 X |
| 4,173,297 | 11/1979 | Pettersen | 222/380 X |
| 4,278,189 | 7/1981 | Kirk, Jr. | 222/385 X |
| 4,640,443 | 2/1987 | Corsette | 222/380 X |
| 4,693,675 | 9/1987 | Venus, Jr. | 222/385 X |
| 4,726,747 | 2/1988 | Skorka | 222/383 X |
| 4,735,347 | 4/1988 | Schultz et al. | 222/385 X |
| 4,823,991 | 4/1989 | Skorka | 222/321 X |
| 4,941,595 | 7/1990 | Montaner et al. | 222/385 X |
| 5,020,696 | 6/1991 | Cater | 222/385 X |
| 5,038,965 | 8/1991 | Cater | 222/378 X |

*Primary Examiner*—David H. Bollinger

[57] ABSTRACT

The lower end of a first hollow vertical cylinder is connected to the upper end of a second vertical hollow cylinder of smaller diameter. A first outer hollow stem open at its ends has an intermediately disposed first external enlargement disposed below the top open end of the first cylinder. A hollow vertical main piston is vertically slidable within the first cylinder. A second inner stem has an upper vertical section which extends upwardly through the main piston and through a bore in the first stem. A vertical fluid discharge path is formed between the upper section and the first stem. An integral lower vertical section of the second stem engages the lower end of the main piston. A fluid discharge port is formed between the first section and the stem. A vertical inner piston is slidable in the second cylinder. A first spring normally biases the stems together, closing the discharge port. A second spring causes the discharge port to open during a selected point on the downstroke.

8 Claims, 3 Drawing Sheets

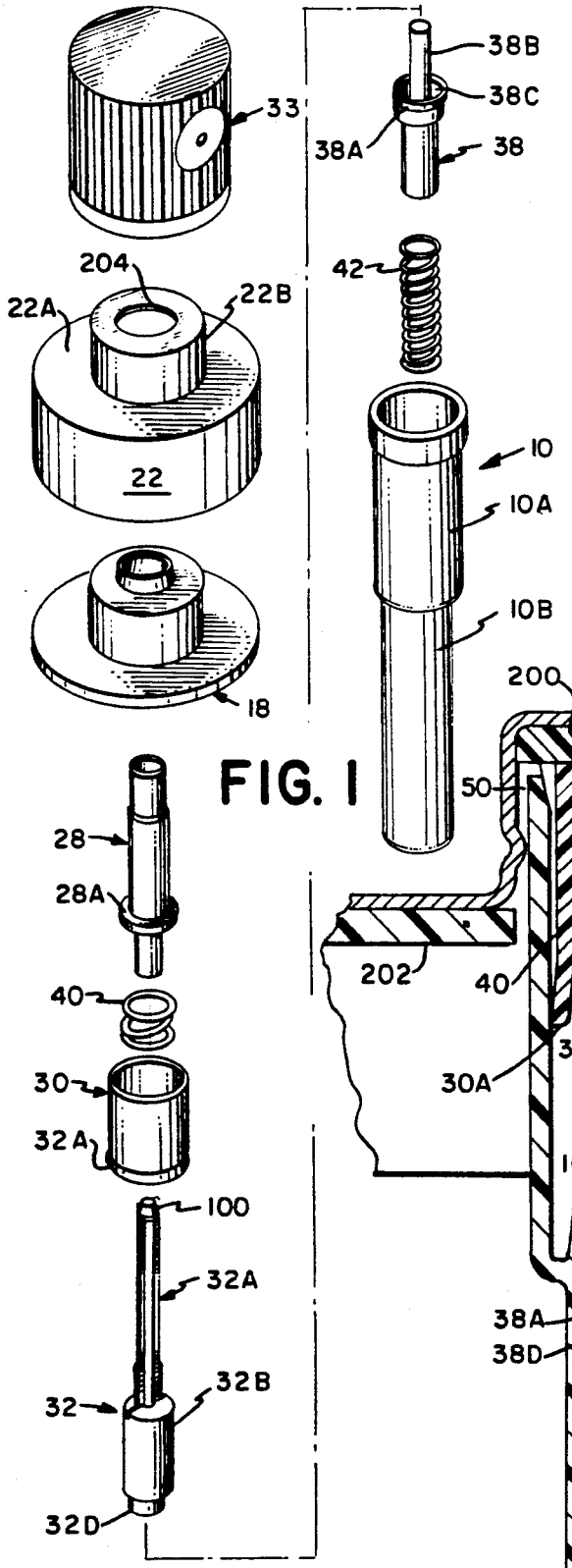
FIG. 1
FIG. 5
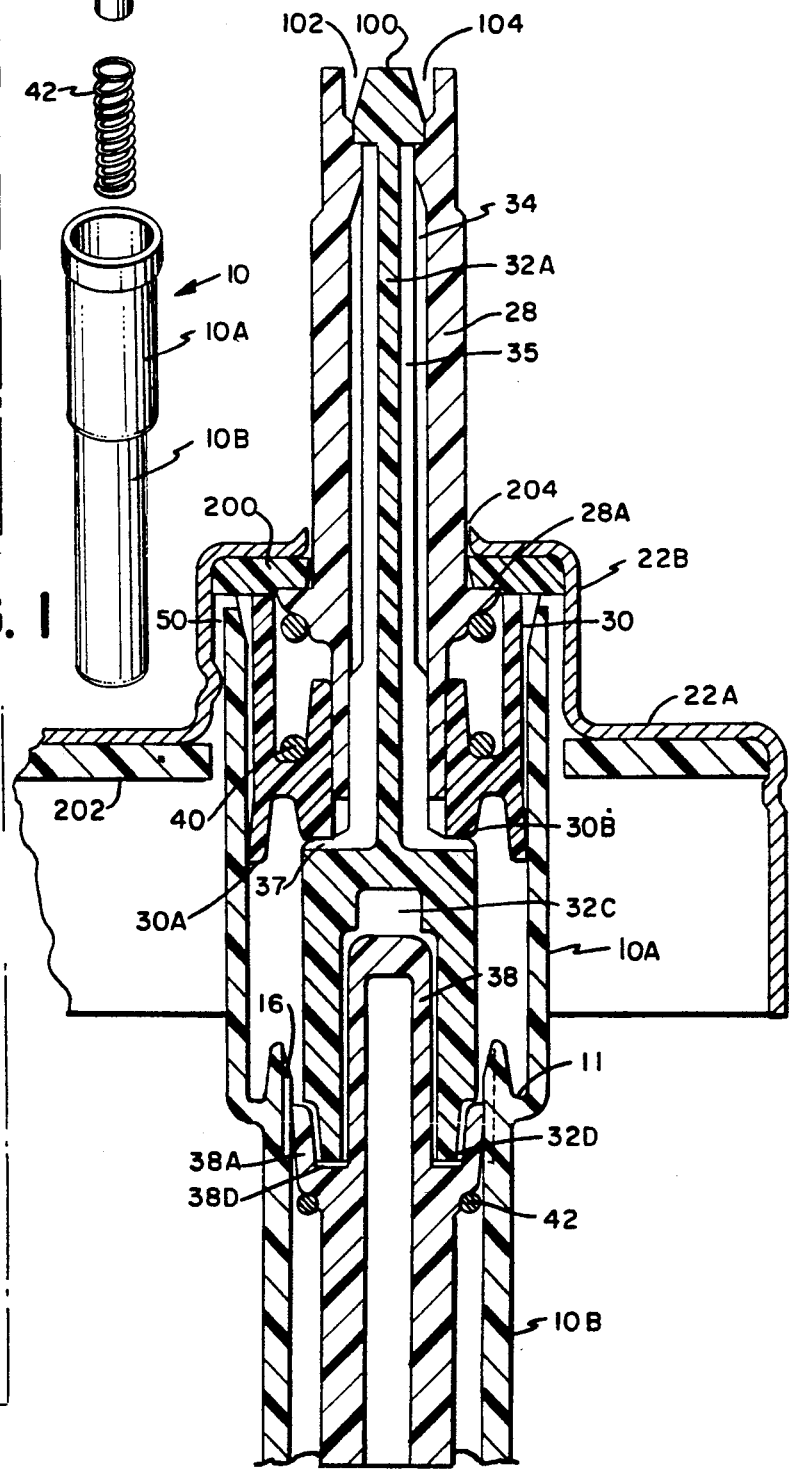

FLUID PUMP DISPENSER FOR PHARMACEUTICAL USE

CROSS REFERENCE TO COPENDING APPLICATION

This application is related to copending application Ser. No. 07/505,601, filed Apr. 6, 1990 and owned by the assignee of the present application.

BACKGROUND OF THE INVENTION

The above identified copending application is directed toward a finger actuated pump dispenser for pharmaceutical applications which not only discharges fluid at a predetermined pressure but also delivers a predetermined dosage regardless of the method of actuation employed. However, when the dispenser is actuated after it has been stored unused for some period, fluid will have evaporated from the volume within the actuator and the fluid pathway between the chamber seal and the finger controlled actuator. Consequently, the dose delivered by the first actuation will be somewhat less then delivered by subsequent actuations. In some pharmaceutical applications, it is essential for the dispenser to deliver an accurate dose upon such first actuation. The present invention eliminates this evaporation and thus insures accurate dose delivery at all times.

SUMMARY OF THE INVENTION

Accordingly, it is an object of the present invention to provide a new and improved finger actuated fluid pump dispenser for pharmaceutical applications which prevents fluid from evaporating from the volume within the fluid pathway between the chamber seal and the actuator.

Another object is to provide a finger actuated fluid pump dispenser for pharmaceutical applications which eliminates evaporation of fluid from the volume within the fluid pathway between the chamber by moving the exit chamber seal to the top of the pump.

Still another object is to provide a new and improved fluid pump dispenser of the character indicated wherein in addition to the elimination of fluid evaporation ambient air is prevented from entering the dispenser.

These and other objects and advantages of this invention will either be explained or will become apparent hereinafter.

In accordance with the principles of this invention, a finger actuated fluid pump dispenser is mounted on a fluid containing vessel.

The dispenser employs a vertical hollow elongated body with an upper section defining a first hollow vertical cylinder having an open upper end and having a first diameter. The body also has an integral lower section defining a second hollow vertical cylinder having a closed lower end with a central opening and having a second and smaller diameter. The lower end of the first cylinder is connected to the upper end of the second cylinder and a vertical bore extends completely through the body. A collar having a central opening encloses the upper end of the first cylinder.

A first outer hollow stem open at upper and lower ends has a first external enlargement intermediate these ends. The first stem has a vertical bore aligned with the body bore. The portion of the first stem intermediate the upper end and the first enlargement extends upwardly through the collar opening. The first enlargement is disposed below the collar, and, together with the remaining portion of the first stem, is disposed within the first cylinder.

A hollow vertical main piston has an upper open end and a lower closed end with a central opening and is disposed and is vertically slidable within the first cylinder.

A second inner stem has an upper vertical section with relatively small cross sectional area which extends upwardly through the main piston and through the bore in the first stem. The upper section is spaced inwardly from this bore, the space between the upper section and the outer stem defining a vertical fluid discharge path. The second stem has an integral lower vertical section with larger cross sectional area. The cross sectional area of the lower section is smaller than that of the second cylinder. The lower section has an upper end which engages the lower end of the main piston in such manner that at least one horizontal channel extends between the lower section and the lower end of the main piston and connects the region between the lower section and the inner wall of the first cylinder to the fluid discharge path.

Port means cooperating with the upper end of the first stem and the upper end of the upper section of the second stem defines a fluid discharge port which has an open position for allowing fluid discharge therethrough and a closed position for blocking fluid discharge therethrough.

A vertical inner piston has an upper end which is adjacent and engagable with the lower end of the lower section. The second piston is vertically slidable in the second cylinder and has a second outwardly extending enlargement intermediate its ends which engages the inner wall of the second cylinder.

First spring means is disposed in the first cylinder within the first piston between the lower end of the first piston and the first enlargement. The first spring means normally biases the outer stem toward the lower section of the inner stem, causing the port means to close the discharge port.

Second spring means is disposed in the second cylinder between the lower end of the body and the enlarged portion of the second piston. An actuator is secured to the upper end of the sleeve and outer stem adjacent the port means.

Means associated with the second piston and the second cylinder and actuated during at a selected position of the inner piston with respect to the second cylinder during an upstroke establishes a fluid transfer path between the fluid in the container and the pump chamber formed by the space subtended by the inner wall of the first cylinder, the second stem and the two pistons. At a selected point during the downstroke, the biasing action of the first spring means is overcome and the discharge port is opened.

As will be explained in more detail below, during an initial priming operation, air is expelled during the downstroke and the chamber is filled with fluid during the subsequent upstroke. Once the dispenser is primed, it requires no further priming. The fluid is discharged during the downstroke and the chamber is refilled with fluid during the subsequent upstroke.

In known constructions, the fluid discharge path is connected at its lower end to a discharge port and at its upper end to the actuator, whereby any fluid remaining in the path after the discharge port is closed is exposed to the atmosphere via the actuator and can evaporate. In contradistinction, in the present invention, the discharge path terminates at its upper end at a discharge port adjacent the actuator, whereby any fluid remaining in the path after the discharge port is closed is sealed in the pump and not exposed to the atmosphere and thus cannot evaporate.

It is frequently necessary to prevent the fluid disposed in the container from being exposed to oxygen. In the present invention, the dispenser can be configured by adding an elastomer gasket to the structure, so that after being secured to the container with the fluid therein, the entire structure can be pressurized in the same manner as if it were to be an aerosol package. The resulting internal pressure will prevent ambient air from entering the structure. This pressure will not affect the functioning of the dispenser.

BRIEF DESCRIPTION OF THE DRAWINGS

FIG. 1 is an exploded view of a preferred embodiment of the invention.

FIG. 5 is a view similar to FIG. 2 showing the preferred embodiment as modified for pressurization.

DETAILED DESCRIPTION OF PREFERRED EMBODIMENT [FIGS. 1-4]

Figure 2:
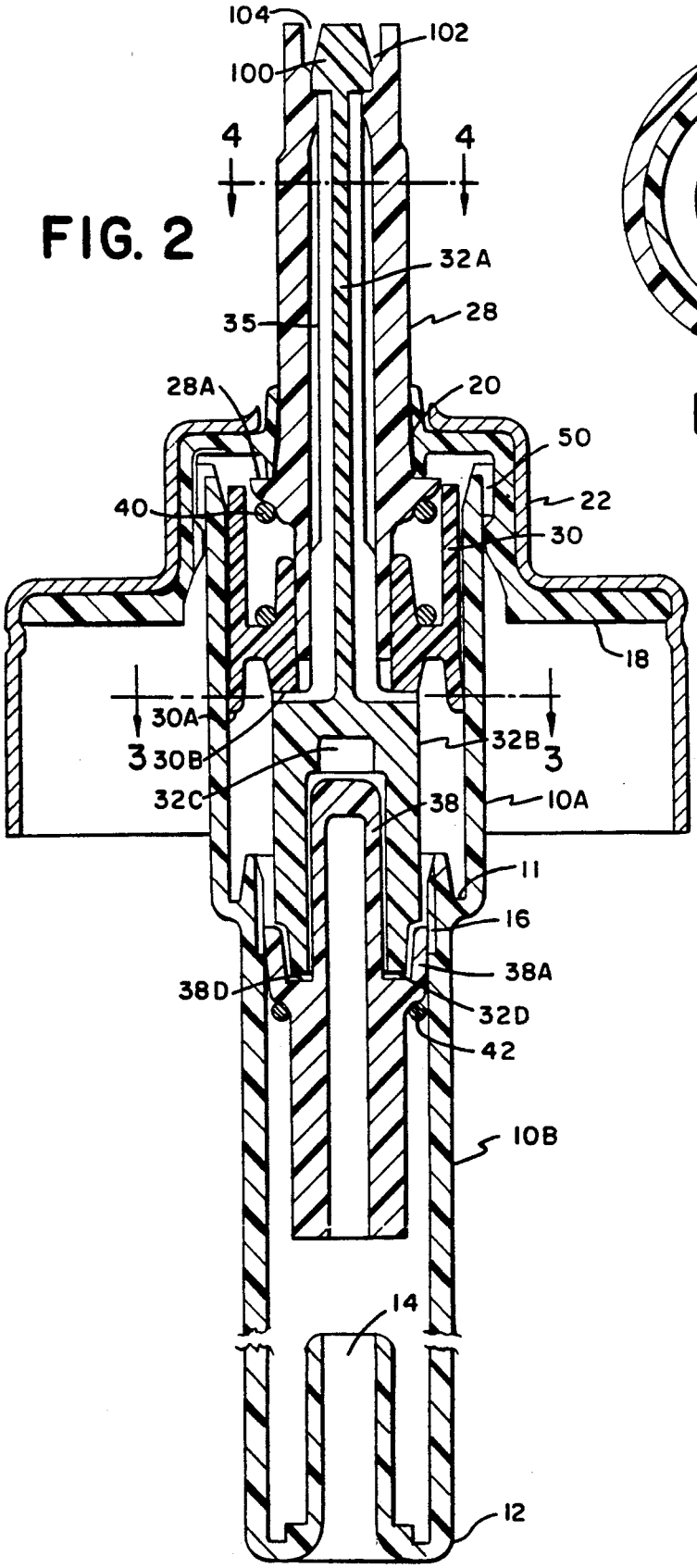
FIG. 2 is a vertical cross sectional view of the preferred embodiment as assembled.

Referring now to FIGS. 1-4, a hollow body has an upper hollow cylinder 10A having a first diameter and an open upper end. The body has an integral lower hollow cylinder 10B having a second and smaller diameter with a lower end 12 having a central opening 14 which is raised above the remainder of this lower end. If desired, opening 14 can be lowered below the remainder of this lower end. The body has a vertical bore which extends completely through the body. Cylinder 10B has an open upper end with an inner recess 16 in its inner wall which is spaced outwardly from the remainder of the inner wall. The upper end of cylinder 10B is integral with the lower end of cylinder 10A but the outer periphery of the lower end of cylinder 10A is spaced away from the outer periphery of the upper end of cylinder 10B by a horizontal circular groove or recess 11.

A collar 18 snaps over the upper end of cylinder 10A and has a central opening 20 aligned with the vertical bore in the body. The collar is spaced from the upper end of cylinder 10A by one or more grooves 50 which form air passages. Collar 18 is surrounded by a cup 22 having a like aligned opening. The cup with the collar and body attached is fitted to the neck of a container of fluid. A vertical dip tube can fitted into the lower end 12 with its upper opening engaging opening 14.

A vertical outer stem 28 open at both ends has a vertical bore aligned with the body bore. Stem 28 has an outwardly extending enlargement 28A disposed intermediate its ends. The upper portion of stem 28 above enlargement 28A extends upwardly through the openings of collar and cup with the enlargement 28A and the remainder of the stem 28 disposed in the first cylinder. The portion of this stem below enlargement 28A is smaller in outer diameter than the upper portion of the sleeve.

A hollow vertical main piston 30 has an open upper end and a lower closed end with a central opening aligned with the cylinder bore. The lower closed end has outer and inner downwardly extending concentric rings 30A and 30B. Piston 30 is vertically slidable within cylinder 10A. Ring 30A is engagable with groove 11 to limit the downward travel of piston 30. Grooves 50 enables air to flow into the region within the first cylinder bounded by the collar and the lower end of the piston 30 to prevent development of a vacuum like condition therein during operation of the dispenser.

An inner stem has a solid upper vertical section 32A of relatively small cross sectional area spaced inwardly from and extending upwardly through the piston 30 and the outer stem 28. Section 32A has vertical channels 35 defining a vertical fluid discharge path or channel 34.

Section 32A has at its upper end an enlarged head 100. The upper end of outer stem 28 has an inner recess 102 contoured to receive head 100 in sealing relationship. This arrangement constitutes a discharge port 104. When the head 100 engages recess 102, port 104 is closed; when the head is separated from the recess, port 104 is open. The port is normally closed and is opened during a downstroke by causing the upper end of the outer stem to be moved downward relative to the head.

The inner stem has a flat base of larger cross sectional area than its vertical portion. This flat base is connected to the top surface of lower section 32B and has horizontal grooves 31, each of which is connected to a corresponding vertical channel 35. The inner ring 30B of the main piston engages the flat base but is spaced above the grooves 31, thus forming with the upper end of section 32B horizontal channels 37 which extend from the region between section 32B and the inner wall of cylinder 10A into the discharge channel 34.

Section 32B has a lower open end with a vertically elongated recess 32C therein. This lower end has a downwardly extending ring 32D.

A hollow vertical inner piston 38 is vertically slidable in the second cylinder. Piston 38 has an outwardly and upwardly extending enlargement 38A intermediate its ends which engages and seals to the inner wall of the second cylinder at all times except when enlargement 38A is aligned with recess 16 at the upper end of cylinder 10B. When this alignment takes place, the enlargement 38A is spaced from recess 16 and fluid can pass therebetween.

The upper end of piston 38 is closed and the upper portion of piston 38 above the enlargement is engagable with the vertical recess 32C. Enlargement 38A has a horizontal circular groove 38C which is engaged by ring 32D when section 38B engages recess 32C.

A first compression spring 40 is disposed within cylinder 10A with its upper end bearing against enlargement 28A and its lower end bearing against the lower end of piston 30. When the dispenser is not actuated, spring 40 exerts an upwardly directed bias on the outer sleeve, forcing it upward to close port 104.

A second compression spring 42 is disposed within cylinder 10B with its upper end bearing against enlargement 38A and its lower end bearing against the lower end of cylinder 10B.

Finger actuator 33 engages the upper end of the outer stem and communicates with port 104.

OPERATION OF THE PREFERRED EMBODIMENT FIGS. 1-4 AFTER BEING PRIMED

When this embodiment is fully primed and at rest, the portion of the cylinder 10A which is subtended by the the inner wall of this cylinder, the inner stem, and the two pistons defines a pump chamber and is filled with fluid. The enlargement 38A is aligned with recess 16. When the actuator 33 is depressed, the pistons and stems move downward reducing the volume of fluid in the first cylinder. When the second piston 38 is lowered, enlargement 38A is moved out of alignment with recess 16, forming a seal between enlargement 38A and the second cylinder. The fluid is displaced from the first cylinder into that portion of the second cylinder 10B which is disposed above the enlargement 38A. The volume of fluid remains constant up to the point of discharge. Because of the differences in diameter between the two pistons, piston 38 moves further downward relative to piston 30. This process continues until a predetermined volume of fluid has been displaced into the second cylinder.

The pressure within the pump chamber is a function of spring forces which act against the pistons. Due to the increased fluid pressure, the first piston and inner stem travel upward relative to the outer stem. The spring gradient [or rate] of spring 40 is significantly higher than that of the spring 42. Consequently, the relative motion of the main piston is significantly smaller than the displacement of the inner piston. The relative motions are mathematically defined and are a function of the cylinder diameters and spring design. These parameters can be so chosen that the relative upward movement of the main piston and inner stem with respect to the outer stem will open port 104 at any desired point during the downstroke. At one extreme point, the port can be made to open at the moment at which all of the fluid has been displaced into the second cylinder.

Once port 104 is opened, the inner piston begins to travel upward under the force of spring and expels the fluid in the lower cylinder upwardly through the upper cylinder, channels 37, channel 34 and the actuator 33.

Once the port is opened, the second piston begins to travel upward under the force of the second spring and expels the fluid. This expulsion takes place before the the second piston engages section 32B of the inner stem. This engagement defines the completion of the downstroke and the initiation of the upstoke. From this point onward, the inner piston and the inner stem move upward as a unit. When the second enlargement becomes aligned with recess 16, a fluid conduction path is established between the fluid in the container, via a dip tube and the space between the fluid in the container, via a dip tube and the space between the enlargement and the inner wall in the second cylinder, and suction force pulls the fluid upward into the first cylinder. The space subtended by the inner wall of the cylinder, the lower section of the inner stem and the two pistons thus forms a pump chamber.

The dosage accuracy can be enhanced by forcing the inner piston to engage opening 14 before the port 104 is opened or by forcing ring 30A of main piston 30 to engage groove 11 before port 104 is opened. One method for accomplishing this action is to increase the biasing action of spring 40. When the inner piston reaches this opening, the reduction of volume in the first cylinder, because of downward actuation, displaces the main piston and the inner stem only, causing the port 104 to open. The motions of both pistons is effectively arrested while the outer stem continue to travel downward. Under these conditions, the dispenser delivers highly accurate dosage, independently of the method of actuation.

PRIMING OPERATION OF THE PREFERRED EMBODIMENT [FIGS. 1-4]

Before the dispenser is charged with fluid, it contains air. During operation in air, since air is compressible, the inner piston is not displaced into the second cylinder in direct proportion to the displacement of the main piston. The direct proportion displacement ensues after the dispenser has been primed because the fluid is not compressible.

The relative displacement of the inner piston away from the inner stem is proportional to the increase in internal pressure, which is inversely proportional to the reduction in volume. At the end of the downstroke, the main piston then engages the recess 11. This action arrests the downward motion of main piston and the inner stem, while the outer stem continues downward travel, opening port 104. Once this port is opened, the air which has been compressed within the dispenser is discharged through channels 37 and channel 34.

DETAILED DESCRIPTION OF PREFERRED EMBODIMENTS FIGS. 5-6

Figure 3:
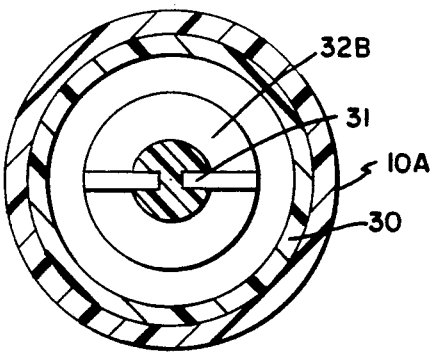
FIG. 3 is a view taken along line 3—3 in FIG. 2.
Figure 4:
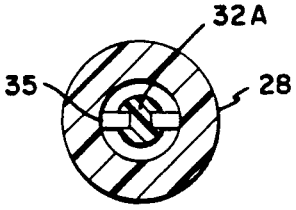
FIG. 4 is a view taken along line 4—4 in FIG. 2.

The embodiment shown in FIGS. 4-5 does not utilize the collar 18 as shown in FIGS. 1-3. Instead, an elastomer gasket 200 is disposed horizontally between the cup 20 and the upper end of the first cylinder 10A, this gasket having the same central opening as the collar. A second gasket 202, made of the same material as the collar, bears against the inside of the lower horizontal portion 22A of cup 22. When the cup engages the neck of a container of fluid, gasket 202 provides a seal between the top of the neck and the inner surface of the cup. The upper vertical portion 22B of the cup is crimped against the outer surface of cylinder 10A. Air passages 50 are retained.

After the dispenser is secured to the container, pressured inert gas is introduced between the inner stem 28 and the cup 22 via annular region 204. While the outer periphery of gasket 202 remains in position, the inner periphery is pushed downward, allowing the gas to flow into the region of cup and container below gasket 202. Once the gas has been introduce to establish the desired level of internal pressure, the elastomer gasket returns automatically to its flat sealing position as a result of its elastomer characteristic. If necessary thereafter, the cup can be crimped again against the cylinder 10A.

Figure 6:
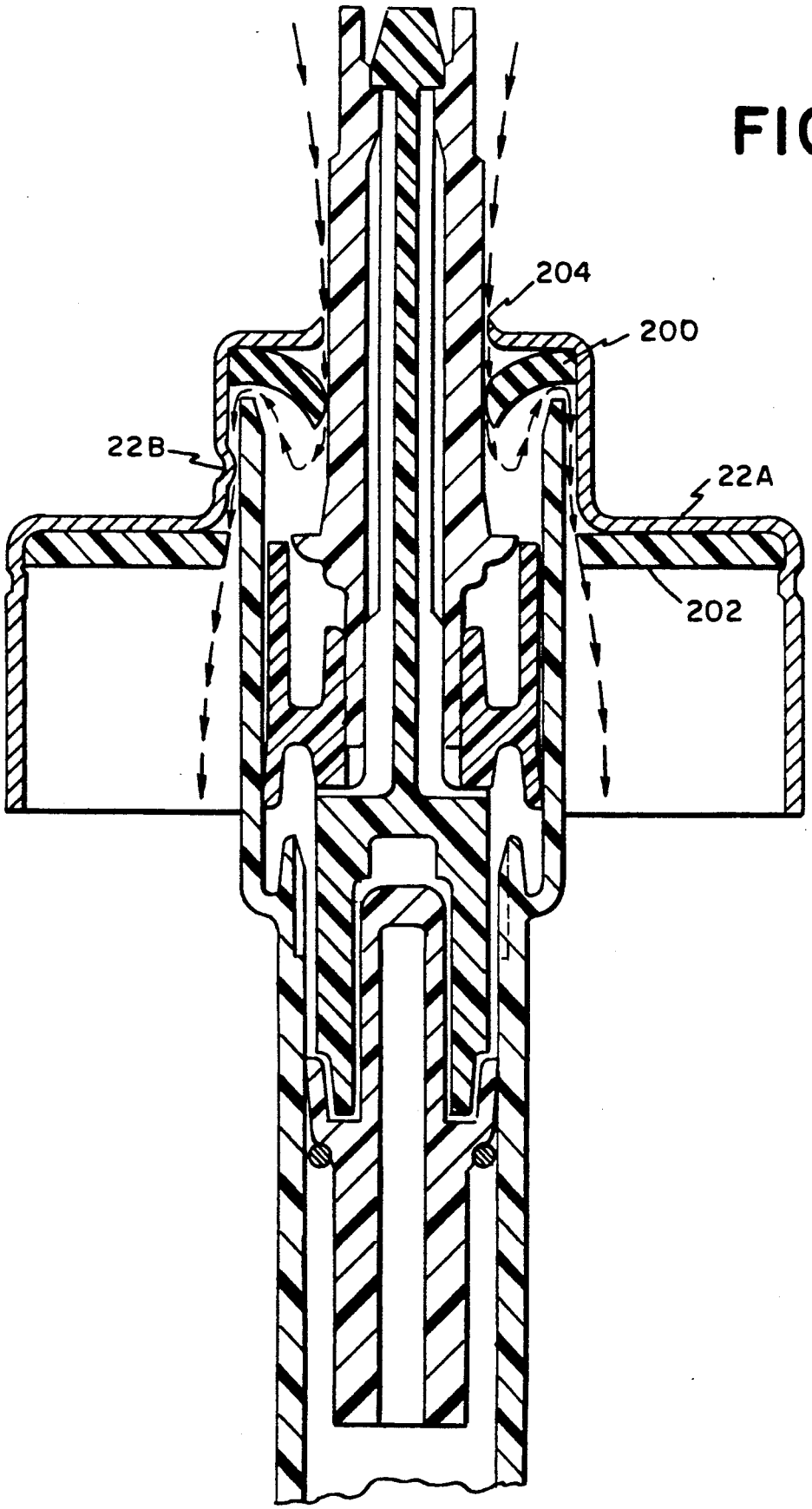
FIG. 6 is a detail view of FIG. 5 illustrating pressurization.

The dispenser of FIGS. 5 and 6 otherwise can be primed and actuated in the same manner as the dispenser of FIGS. 1-4.

While the invention has been described with particular reference to the embodiments shown in the drawings, the protection thereof is to be limited only by the terms of the claims which follow.

What is claimed is:

1. A finger actuated pump dispenser mounted on a fluid containing vessel and comprising:

a vertical hollow elongated body having an upper section defining a first hollow vertical cylinder with a first diameter and open upper end and an integral lower section defining a second hollow vertical cylinder with a second and smaller diameter and a closed lower end with a central opening, the lower end of the first cylinder being joined to an open upper end of the second cylinder, the body having a vertical bore extending through both cylinders;

collar means having a central opening aligned with the bore and enclosing the upper end of the first cylinder;

a first outer hollow stem open at upper and lower ends and having a first outwardly extending enlargement intermediate these ends, the first stem having a vertical bore aligned with the body bore, the portion of the first stem intermediate the upper end and the first enlargement extending upwardly through the collar means opening with the first enlargement being disposed below the collar, the first enlargement and the remaining portion of the first stem being disposed within the first cylinder;

a hollow vertical main piston having a upper open end and a lower closed end having a central opening which is aligned with the body bore, the main piston being disposed and vertically slidable along the outside of the first stem within the first cylinder;

a second inner stem having an upper vertical section with relatively small cross sectional area which extends upwardly through the main piston and through the vertical bore, the upper section being spaced inwardly from the inner surface of the first stem, thus defining a vertical fluid discharge path, the second stem having an integral lower vertical section with a cross sectional area which is larger than that of the uppersection and smaller than that of the second cylinder, the upper end of the lower section engaging the lower end of the main piston in such manner that at least one horizontal channel is formed and disposed between the upper end of the lower section and the lower end of the main piston and connects the region between the inner wall of the first cylinder and the lower section with the fluid discharge path;

the upper ends of the first stem and the upper section of the second stem being engagable with and disengable from each other and cooperating together to define a fluid discharge port which has an open position when these ends are disengaged for allowing fluid discharge therethrough and a closed position when these ends are engaged for blocking fluid discharge therethrough;

a vertical inner piston vertically slidable in the second cylinder with an upper end adjacent and engagable with the lower end of the lower section, the inner piston having a second outer enlargement intermediate its ends which engages the inner wall of the second cylinder;

first spring means disposed within the first cylinder between the lower end of the main piston and the first enlargement, the first spring means causing the discharge port to be closed except during a downstroke movement of the pistons and stems, the port being opened a selected point during said downstroke movement;

a second spring disposed within the second cylinder between the lower end of the second cylinder and the second enlargement; and means associated with the inner piston and the second cylinder which when actuated during an upstroke movement of the pistons and stems following the downstroke movement establishes a fluid transfer path between the fluid in the container and a pump chamber formed by the space subtended by the inner wall of the first cylinder, the second stem and the two pistons when the inner piston attains a selected position with respect to the second cylinder.

2. The dispenser of claim 1 wherein the upper end of the upper section of the second stem has a head and the upper end of the first stem has a recess conforming to the head, the port being closed when the head engages the recess and being opened when the head is spaced from the recess.

3. The dispenser of claim 1 wherein the means associated with the inner piston and second cylinder includes an enlarged recess disposed in the inner wall of the second cylinder at its upper end, said fluid transfer path being established when the second enlargement is aligned with said recess.

4. the dispenser of claim 1 further including actuator means connected to the upper end of the inner stem and disposed adjacent but above the upper end of the first stem and the upper end of the upper section of the second stem.

5. The dispenser of claim 1 wherein the collar means includes a horizontal elastomer gasket.

6. The dispenser of claim 1 wherein the top surface of the lower section of the second stem contains spaced grooves, the lower end of the main piston being spaced above said grooves, the grooves together with adjacent portions of the inner stem and the main piston defining the at least one horizontal channel.

7. The dispenser of claim 1 wherein the lower end of the first cylinder has a horizontal groove adjacent the upper end of the second cylinder and wherein the lower end of the main piston engages said groove during the downward stroke motion before the port is opened.

8. The dispenser of claim 1 wherein the inner piston has a lower end which is moved downward during the downward stroke motion to engage the central opening in the closed lower end of the second cylinder before the port is opened.

* * * * *